United States Patent [19]

Panicci

[11] 4,303,170

[45] Dec. 1, 1981

[54] SELF-RIGHTING TRAINING CUP

[75] Inventor: Richard L. Panicci, Hanover, Mass.

[73] Assignee: Kiddie Products, Inc., Avon, Mass.

[21] Appl. No.: 106,839

[22] Filed: Dec. 26, 1979

[51] Int. Cl.[3] ..... A47G 19/22

[52] U.S. Cl. ..... 220/70; 220/90.4; 215/1 R

[58] Field of Search ..... 220/69, 70, 90.2, 90.4, 220/90.6; 215/1 R, 10; 206/502, 520

[56] References Cited

U.S. PATENT DOCUMENTS

| | | | |
|---|---|---|---|
| 441,155 | 11/1890 | Gross | 220/90.2 |
| 2,601,767 | 7/1952 | Wall | 220/69 |
| 3,549,044 | 12/1970 | Lerner | 220/90.4 |
| 3,966,077 | 6/1976 | Jardine | 220/70 |

FOREIGN PATENT DOCUMENTS

| | | | |
|---|---|---|---|
| 1164969 | 9/1969 | United Kingdom | 220/90.4 |
| 1229426 | 4/1971 | United Kingdom | 220/70 |

*Primary Examiner*—George E. Lowrance

[57] ABSTRACT

A self-righting training cup comprises a lower hemispherical portion having a flat to define the cup bottom and an upper cylindrical portion tangent with the lower portion, the diameter of the lower portion having a ratio to the effective liquid containing height of the upper portion of at least 4.

9 Claims, 2 Drawing Figures

SELF-RIGHTING TRAINING CUP

The invention relates to self-righting training cups for children and more particularly to a cup which will self-right even when filled with liquid.

In the past, self-righting training cups have been heavily weighted in the base to provide a righting force when the cup is tipped. Typical such cups weigh in excess of 135 grams. Despite their weight, however, existing typical self-righting training cups will not right themselves when completely filled.

It is a principal object of this invention to provide a training cup which is self-righting even when filled. It is a further object of this invention to provide a self-righting training cup which is lighter than typical such cups.

In general this invention features a cup comprising a hemispherical lower wall portion having a flat defining the cup bottom. The cup also comprises a cylindrical upper wall portion tangent to the lower wall portion and extending upwardly to the cup rim. The diameter of the lower wall portion to the effective liquid containing height of the upper wall portion above said lower wall portion is at least 4.

The invention also features a lid in combination with the cup comprising a transverse wall having openings therein and having a side wall integral with the transverse wall for removable sealing engagement with the upper cup wall portion. The lid defines the maximum volume of the cup and defines the height of the upper wall portion above the point of tangency thereof with the lower wall portion. Advantageously, the weight of said cup per fluid ounce capacity of said cup is less than 15 grams.

In preferred embodiments the radius of the hemispherical lower wall portion extends from a point on the vertical axis of the cup. Also in preferred embodiments the cup bottom is weighted.

Figure 1:
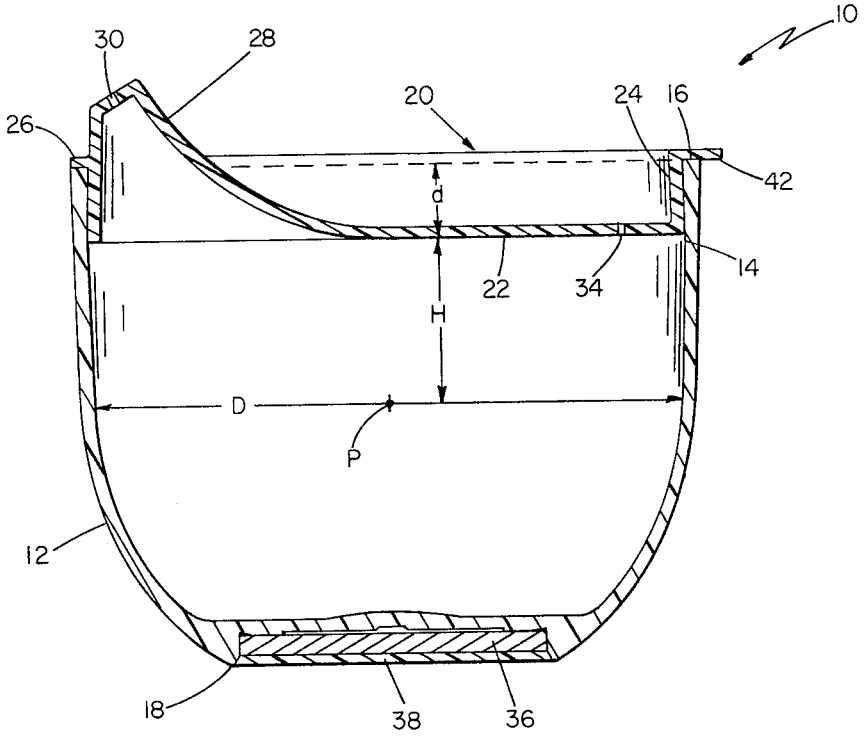
Figure 2:
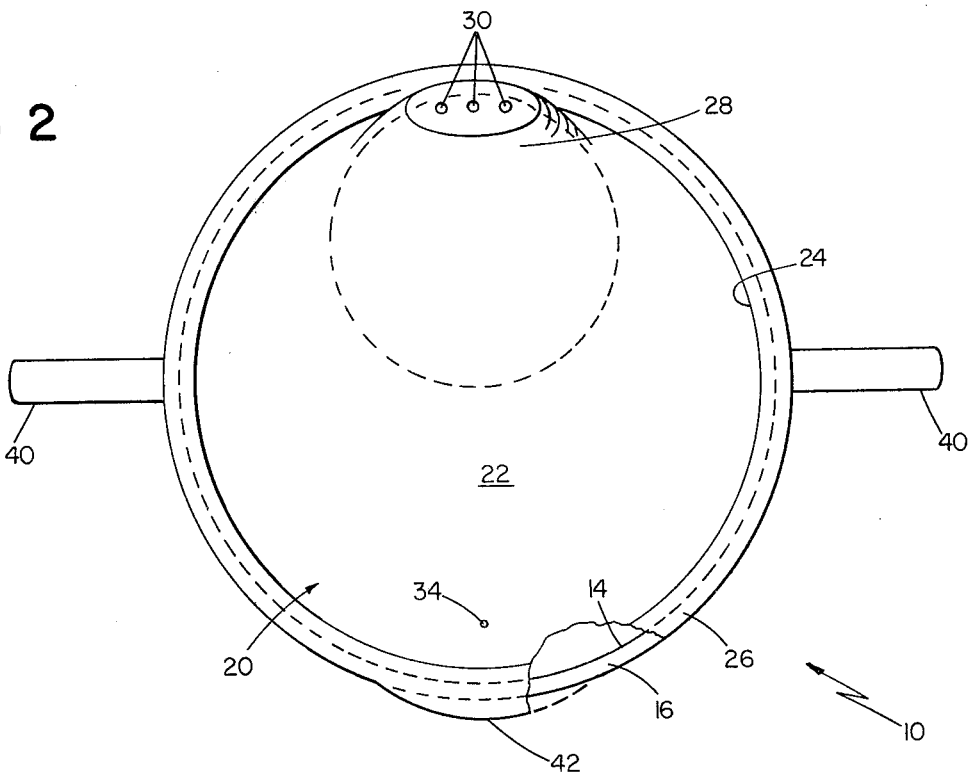

Other objects, features and advantages of this invention will be apparent to those skilled in the art from the following detailed description of a preferred embodiment thereof, taken together with the accompanying drawings, in which:

FIG. 1 is an elevation view in section of a cup made according to the invention; and FIG. 2 is a plan view of the cup illustrated in FIG. 1.

As illustrated in FIG. 1, a training cup 10 according to the invention comprises integral lower and upper cup wall portions 12, 14. A removable lid 20 is sealingly secured to the rim 16 of the cup.

The lower wall portion 12 of the cup 10 is generally hemispherical having a flat 18 defining the cup bottom and extending upwardly from the bottom 18 along a radius, preferably extending from a point P on the vertical axis of the cup. The upper wall portion 14 of the cup 10 extends essentially vertically as a right cylinder from the lower wall portion 12, the upper and lower wall portions being tangent. For convenience in mold removal, the upper wall portion 14 is actually angled slightly outwardly (i.e., 1°) from the vertical as it extends upwardly from the lower wall portion 12 (the inner wall has a slight inward protrusion for sealing the inner wall against lid 20).

Lid 20, as shown in FIGS. 1 and 2, comprises a transverse wall 22 extending across the upper wall portion 14 of cup 10. The lid also has an integral, vertical, essentially cylindrical, side wall 24 sealingly engaging the inside of upper wall portion 14 and a lip 26 about wall 24 for engaging cup rim 16 and defining the extent to which the lid can be inserted within the cup. An integral drinking spout 28 having three openings 30 is formed on one side of lid 20. A vent hole 34 is formed in lid 20 opposite spout 28. An alternative lid form, not illustrated, for children who have mastered drinking with the spout, omits the spout 28, and simply provides openings 30, 34 in wall 22.

It has been found that if the effective liquid containing height H of the cylindrical upper portion 14 is limited relative to the diameter D (through point P) of the lower portion 12, the cup will have a self-righting tendency, even when filled with liquid. The ratio of the diameter D of lower portion 12 to the effective maximum height H of liquid in the upper portion 14, i.e., the distance from the point of tangency of the upper and lower wall portions 12, 14, (or the position of point P on the cup axis) to the underside of the lid transverse wall 22, in the illustrated embodiment is at least 4 and preferably greater, e.g., in the range of 4–5, to provide such self-righting ability. Thus, in a preferred embodiment, the outer diameter of the lower portion is 3.250 inches and the height of the upper portion is 1.099 inches, which is reduced by the distance d to which lid 20 protrudes into the cup, approximately 0.437 inches, to yield an effective height H for upper portion 14 of about 0.662 inches and a ratio D/H of 4.909, i.e., nearly 5.

It has been found that a cup so designed has a significant self-righting tendency, even when filled, without the addition of any weight to the cup bottom. It has been found to be desirable to add weight to the cup bottom to assure consistent righting of the filled cup when tipped. Weighting is necessary to assure righting of the partially filled cup. Thus a steel disc 36 is placed in the cup base and is sealed by plastic disc 38. In the illustrated embodiment, disc 36 weighs 26.6 grams and the total weight cup is about 77.4 grams, the cup being designed to hold approximately 6 (i.e., 6.25) fluid ounces.

In the illustrated embodiment, the cup is made of polypropylene. The lid is made of high density polyethylene. The cup and the lid are injection molded, the cup normally being made with handles 40, as shown in FIG. 2, and the lid being made with a tab 42, also shown in FIG. 2, for convenience in removing the lid from the cup. After the cup is molded, weight 36 is placed in the base and polypropylene disc 38 is placed over the weight and is sealed to the base by ultrasonic sealing, encapulating the steel disc 36 in the base of the cup.

In use the cup 10 is filled with liquid and cover 20 is placed on the cup. Should the cup be tipped the cup will right itself whether partially or completely filled. Advantageously, since the cup has a significant self-righting tendency without any weighting, when completely filled, only a small weight is required to be added to assure consistent righting of the cup when filled or only partially filled, resulting in a lightweight cup, e.g., weighing less than 15 grams per fluid ounce of cup capacity. Thus the 6.25 fluid ounce cup as above described has a total weight of 77.4 grams or 12.38 grams per fluid ounce capacity of the cup, weight 36 being 26.6 grams or approximately one-third (34.4%) of the total cup weight; typical available self-righting (approximately 6 fluid ounce) cups are not reliably self-righting when filled to capacity and are considerably heavier, ranging in weight from 136.8 to 156.8 grams or from about 20.2 to 23.9 grams per fluid ounce capacity. Thus, the present invention provides a reliably self-righting and relatively light weight cup.

Other embodiments of this invention will occur to those skilled in the art which are within the scope of the following claims.

What is claimed is:

1. A self-righting cup having a lower portion and an upper portion, said lower portion having a flat defining the bottom of said cup and a rounded sidewall extending upwardly therefrom, said upper portion having a sidewall which extends upwardly from said rounded sidewall of said lower portion, wherein to assure self-righting of said cup, the ratio of the outer diameter of said cup at the point of intersection of said upper and lower portions to the height of said upper portion is at least 4.

2. The cup claimed in claim 1 in which said rounded sidewall is hemispherical and extends upwardly along a radius, said radius extending from a point on the vertical axis of said cup.

3. The cup claimed in either of claims 1 or 2 in which a weighting member is provided in the cup bottom.

4. The cup claimed in claim 1 in combination with a lid for said cup, said lid comprising a transverse wall extending across the upper portion of said cup, a plurality of openings in said transverse wall and a side wall integral with said transverse wall removably sealingly engaging said sidewall of said upper portion, the bottom of said transverse wall of said lid defining the top of said upper portion of said cup for the purpose of measuring the height of said upper portion for the ratio.

5. The cup claimed in claim 1 in which said diameter to height ratio is in the range of 4–5.

6. The cup claimed in claim 1 in which said diameter to height ratio is on the order of 5.

7. The cup claimed in any one of claims 4, 5 or 6 in which a weighting member is provided in said cup bottom.

8. The cup claimed in claim 5 in which the ratio of the weight, in grams, of said cup per fluid ounce of capacity of said cup is less than 15.

9. The cup claimed in claim 8 in which said weight is equal in weight to approximately one-third of the total cup weight.

* * * * *